US010944217B2

(12) United States Patent
Maesoba et al.

(10) Patent No.: US 10,944,217 B2
(45) Date of Patent: Mar. 9, 2021

(54) TERMINAL FITTING

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Hiroyoshi Maesoba, Mie (JP); Toshifumi Ichio, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 0 days.

(21) Appl. No.: 16/629,118

(22) PCT Filed: Jun. 20, 2018

(86) PCT No.: PCT/JP2018/023446
§ 371 (c)(1),
(2) Date: Jan. 7, 2020

(87) PCT Pub. No.: WO2019/012931
PCT Pub. Date: Jan. 17, 2019

(65) Prior Publication Data

US 2020/0227863 A1 Jul. 16, 2020

(30) Foreign Application Priority Data

Jul. 11, 2017 (JP) ..... 2017-135245

(51) Int. Cl.
*H01R 13/64* (2006.01)
*H01R 13/6476* (2011.01)
(Continued)

(52) U.S. Cl.
CPC ..... *H01R 13/6476* (2013.01); *H01R 4/185* (2013.01); *H01R 13/11* (2013.01); *H01R 13/4367* (2013.01); *H01R 13/506* (2013.01)

(58) Field of Classification Search
CPC ..... H01R 13/6476
See application file for complete search history.

(56) References Cited

U.S. PATENT DOCUMENTS 5,695,368 A 12/1997 Joly et al.
7,717,759 B2 * 5/2010 Ishigami ..... H01R 13/432 439/851

(Continued)

FOREIGN PATENT DOCUMENTS

JP 9-147948 6/1997
JP 10-055836 2/1998

(Continued)

OTHER PUBLICATIONS

International Search Report dated Sep. 11, 2018.

*Primary Examiner* — Ross N Gushi
(74) *Attorney, Agent, or Firm* — Gerald E. Hespos; Michael J. Porco; Matthew T. Hespos

(57) ABSTRACT

It is aimed to improve durability by reducing a stress generated in a resilient contact piece. A terminal fitting (50) includes a box portion (60) in the form of a rectangular tube and a pair of resilient contact pieces (86, 87) accommodated in the box portion (60) and capable of contacting a tab (95) of a mating terminal inserted into the box portion (69) while resiliently sandwiching the tab.

6 Claims, 10 Drawing Sheets

(51) Int. Cl.

| | |
|---|---|
| ***H01R 4/18*** | (2006.01) |
| ***H01R 13/11*** | (2006.01) |
| *H01R 13/436* | (2006.01) |
| *H01R 13/506* | (2006.01) |

(56) References Cited

U.S. PATENT DOCUMENTS

| | | | |
|---|---|---|---|
| 2001/0019925 | A1 | 9/2001 | Heimueller |
| 2001/0049237 | A1 | 12/2001 | Saka et al. |

FOREIGN PATENT DOCUMENTS

| | | |
|---|---|---|
| JP | 2001-351714 | 12/2001 |
| JP | 2013-089399 | 5/2013 |
| JP | 2015-220017 | 12/2015 |

* cited by examiner

TERMINAL FITTING

BACKGROUND

Field of the Invention

The invention relates to a terminal fitting.

Related Art

Japanese Unexamined Patent Publication No. 2015-220017 discloses a female terminal fitting with a tubular terminal connecting portion having an opening into which a male terminal fitting is insertable and a resilient contact piece provided on a back side of the opening of the terminal connecting portion and configured to contact the male terminal fitting by projecting inwardly of the terminal connecting portion. The resilient contact piece is folded rearward into a chevron shape from the front edge of a bottom wall of the terminal connecting portion. A ceiling wall of the terminal connecting portion is provided with a bead struck down and having a substantially trapezoidal shape in a front view. The male terminal fitting is inserted into the opening of the terminal connecting portion from the front is sandwiched vertically between a top part of the resilient contact piece and the lower end surface of the bead so that the female terminal fitting and the male terminal fitting become conductive.

When the male terminal fitting is sandwiched by the resilient contact piece and the ceiling wall, a folded part of the resilient contact piece (boundary part between the bottom wall of the terminal connecting portion and the resilient contact piece) is deflected to be bent farther if the resilient contact piece is pushed down and resiliently deformed. Since a stress concentrates on the folded part of the deflected resilient contact piece, the resilient contact piece may be deformed plastically or broken if the amount of deflection is large.

The invention was completed on the basis of the above situation and aims to reduce a stress generated in a resilient contact piece.

SUMMARY

The invention is directed to a terminal fitting with a box in the form of a rectangular tube, and two resilient contact pieces accommodated in the box. The resilient contact pieces are capable of contacting a tab of a mating terminal inserted into the box while resiliently sandwiching the tab.

The two resilient contact pieces are configured to contact the tab of the mating terminal while resiliently sandwiching the tab. Thus, a stress generated in each resilient contact piece can be reduced by reducing the amount of deflection of one resilient contact piece as compared to a configuration in which one resilient contact piece is resiliently deformed to contact a tab.

A wall of the box may be cut substantially in the same area as contact points of the resilient contact pieces with the tab with respect to an inserting direction of the tab, thereby forming a cutout. Cutting the wall of the box substantially in the same area as the contact points of the resilient contact pieces with the tab with respect to the inserting direction of the tab to form the cutout changes an impedance near the contact points of the resilient contact pieces in the terminal fitting. By changing the impedance near the contact points of the resilient contact pieces, the impedance can be matched with an impedance in a part of the terminal fitting different from the vicinity of the contact points.

The box may have an escaping portion capable of avoiding interference with the resilient contact pieces. Thus, the resilient contact pieces enter the escaping portion when being resiliently deformed to sandwich the tab, thereby avoiding interference with the box. In this way, improper deformation of the resilient contact pieces can be prevented.

The terminal fitting may include a crimping portion to be crimped to an outer periphery of a core of a wire, and a coupling portion formed into a rectangular tube by bending a metal plate. The coupling portion couples a rear part of the box and a front part of the crimping portion. The box may include a box base plate disposed to cover an outer surface of a first of the resilient contact pieces, a box ceiling plate disposed to cover an outer surface of a second of the resilient contact pieces, and left and right box side plates disposed substantially at a right angle to the box base plate and the box ceiling plate. The coupling includes a coupling base plate connected to a rear end of the first resilient contact piece, left and right coupling side plates connected substantially at a right angle to both left and right sides of the coupling base plate, and a coupling ceiling plate extending substantially at a right angle from one of the coupling side plates, facing substantially parallel to the coupling base plate and connected to a rear part of the other resilient contact piece, and rear parts of the left and right box side plates. Front parts of the left and right coupling side plates are flush with and adjacent to each other. According to this configuration, a lateral width of the box can be made smaller in accordance with a lateral width of the coupling portion and the terminal fitting can be reduced in size while a part constituted by the box and the coupling portion is formed by bending one metal plate.

The first resilient contact piece may be resiliently deformable with a front part of the coupling base plate substantially as a fulcrum, and the second resilient contact piece is resiliently deformable with a front part of the coupling ceiling plate substantially as a fulcrum. The coupling portion may include a supporting wall extending from an edge of the other coupling portion-side side plate and disposed to overlap on an outer surface of the coupling ceiling plate, and the box may include a supporting piece extending rearward from a rear part of the box base plate and disposed to overlap on an outer surface of the coupling base plate. According to this configuration, the position of the fulcrum of resilient deformation of the second resilient contact piece connected to the coupling ceiling plate can be set clearly at the front part of the coupling ceiling plate. Since the supporting piece extending rearward from the rear part of the box base plate is disposed to overlap on the outer surface of the coupling base plate, the position of the fulcrum of resilient deformation of the first resilient contact piece connected to the coupling base plate can be set clearly at the front end part of the coupling base plate.

DETAILED DESCRIPTION

One specific embodiment of the invention is described with reference to FIGS. 1 to 12. Note that, in the following description, a left side in FIGS. 1 and 3 to 11 is defined as a front side concerning a front-rear direction. Upper and lower sides shown in FIGS. 1, 2, 4 to 8, 10 and 11 are defined as upper and lower sides concerning a vertical direction. Left and right sides shown in FIGS. 2 and 12 are defined as left and right sides concerning a lateral direction.

Figure 3:
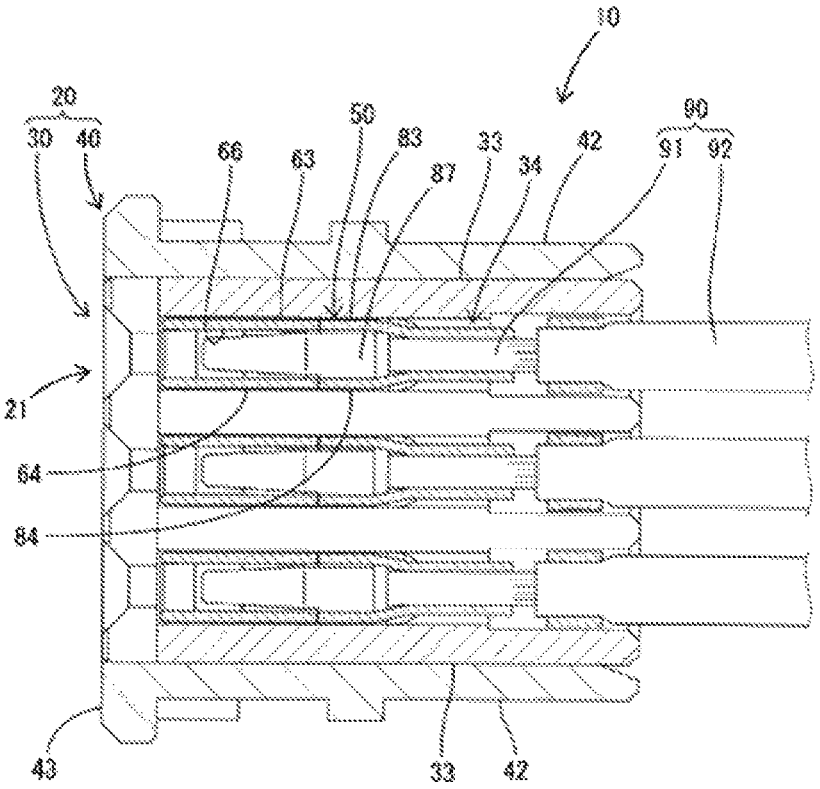
FIG. 3 is a section along A-A of FIG. 2.
Figure 4:
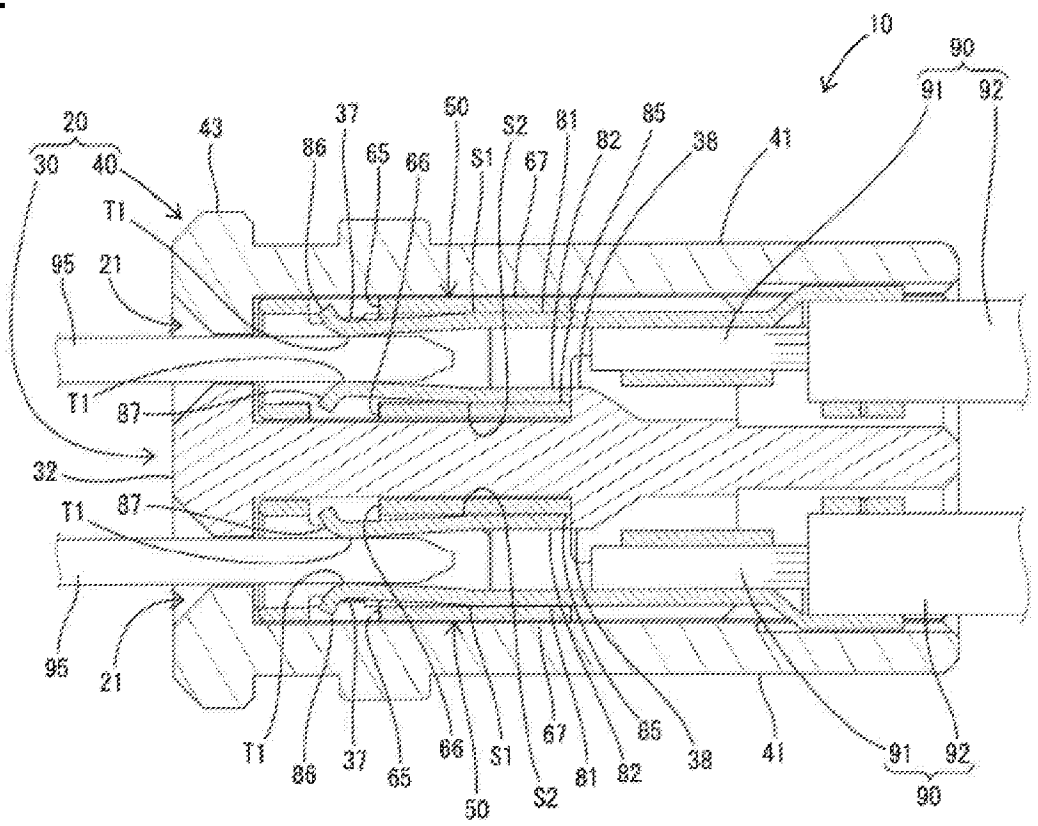
FIG. 4 is a section along B-B of FIG. 2 in a state where tabs of mating terminals are inserted.

As shown in FIGS. 3 and 4, a terminal unit 10 of this embodiment is configured by accommodating terminal fittings 50 into a dielectric 20. The terminal unit 10 comprises a shield terminal surrounded by a rectangular tubular outer conductor (not shown) made of a metal material. The shield terminal is a connecting member of a wiring harness for high-speed communication circuit in an automotive vehicle.

Figure 1:
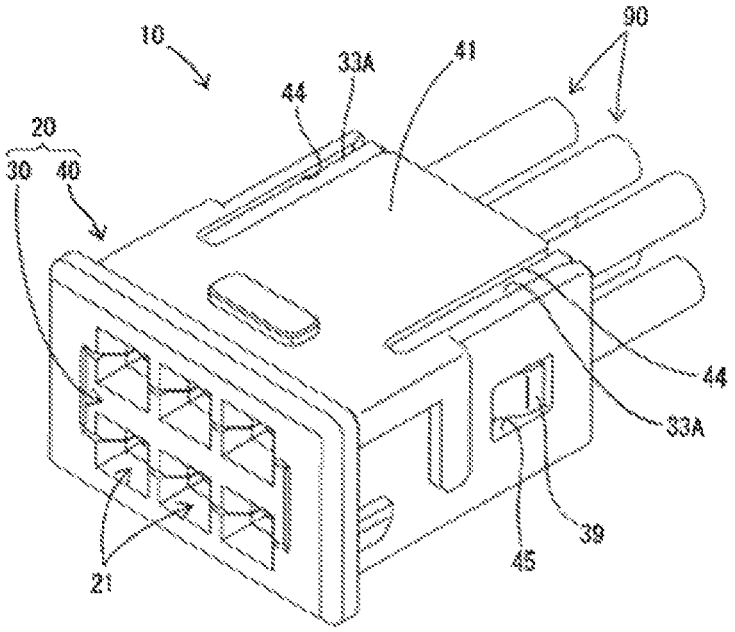
FIG. 1 is a perspective view of parts of a terminal unit and wires of an embodiment.
Figure 2:
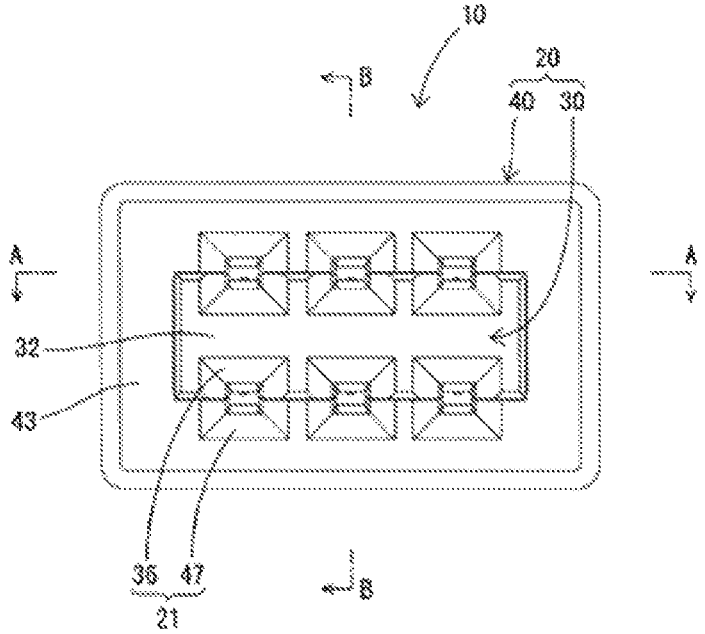
FIG. 2 is a front view of the terminal unit.

As shown in FIGS. 1, 3 and 4, the dielectric 20 accommodates the terminal fittings 50 with wires 90 drawn out rearward. The front surface of the dielectric 20 is formed with insertion holes 21 for allowing the insertion of tabs 95 of mating terminals into terminal accommodation chambers 34 to be described later. The dielectric 20 includes a housing 30 into which the terminal fittings 50 are mounted, and a front member 40 with which the housing 30 is assembled from the front.

Figure 5:
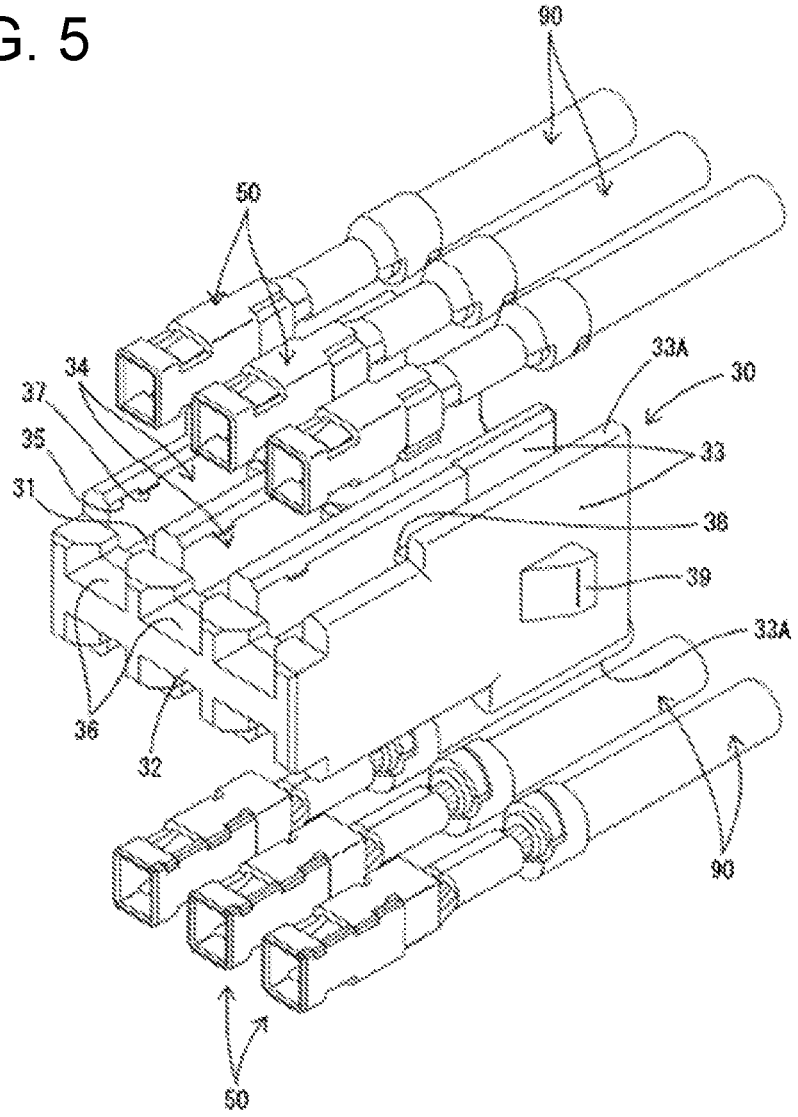
FIG. 5 is a perspective view showing a state where a housing member and terminal fittings are separated in the terminal unit viewed obliquely from above.

As shown in FIG. 5, the housing member 30 includes a substantially rectangular base plate 31, a front wall 32 substantially orthogonally connected to a front part of the base plate 31 to extend up and down, and four side walls 33 substantially orthogonally connected to the base plate 31 to extend up and down. The housing 30 includes terminal accommodation chambers 34 separated in upper and lower stages and laterally arranged in parallel. The terminal accommodation chambers 34 are defined as long grooves extending in the front-rear direction by the front wall 32 and the four side walls 33. The upper and lower surfaces of the housing 30 are respectively formed with openings 35 enabling the terminal fittings 50 to be mounted into the terminal accommodation chambers 34. The front wall 32 of the terminal accommodation chamber 34 is formed with a cutout 36 communicating with the opening 35. The cutout 36 is formed into a tapered shape so that a cutout width (cutout area) becomes smaller toward a rear end.

The side wall 33 is formed with a restricting projection 37 to be locked to a front part of the terminal fitting 50. The restricting projection 37 restricts the withdrawal of the terminal fitting 50 from the opening 35 by being locked to the terminal fitting 50 in the terminal accommodation chamber 34. A rib 33A is formed on an upper part of the upper side wall 33 and extends up from a rear area. A rib 33A also is formed on a lower part of the lower side wall 33 and extends down from a rear area. The base plate 31 is formed with movement restricting portions 38 for restricting rearward movements of the terminal fittings 50 by contacting the terminal fittings 50 while projecting inwardly of the respective terminal accommodation chambers 34. Locking projections 39 are formed on both left and right outer side surfaces of the housing 30 and are to be locked to the front member 40.

Figure 6:
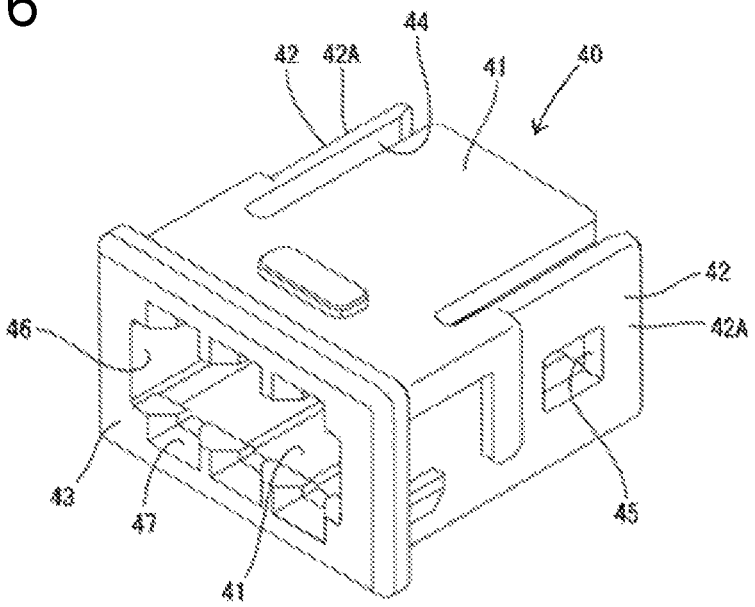
FIG. 6 is a perspective view of a front member.

As shown in FIG. 6, the front member 40 is a single component with upper and lower closing portions 41, 41, left and right side plates 42, 42 and a front wall 43. The upper and lower closing portions 41, 41 are integrated via the left and right side plates 42, 42 and individually close the openings 35 on an upper surface and the openings 35 on a lower surface in the housing 30. The left and right side plates 42, 42 are connected to both left and right end parts of the upper and lower closing portions 41, 41 and cover both left and right side surfaces of the housing 30. The front wall 43 is connected substantially orthogonally to front end parts of the closing portions 41, 41 and front end parts of the side plates 42, 42. The front member 40 is formed with left and right slits 44 by cutting boundary parts between the closing portions 41 and the side plates 42 (four corners of the front member 40) forward from a rear end part. The slits 44 are filled up by the ribs 33A of the housing member 30 fit therein.

Areas of the side plates 42, 42 formed with the slits 44 in the front-rear direction (parts rearward of a position closer to a front end than a center in the front-rear direction) serve as resilient locking pieces 42A resiliently deformable in the lateral direction and lockable to the locking projections 39 of the housing 30. A locking hole 45 that penetrates each side plate 42 in a plate thickness direction and is locked to the locking projection 39 of the housing 30.

A through hole 46 penetrates through a central part of a wall surface of the front wall 43 in the front-rear direction, and the front wall 32 of the housing 30 is inserted therein. The through hole 46 is formed with three recesses 47 by cutting an upper edge part (front end part of the upper closing portion 41) upward and three recesses 47 by cutting a lower edge part (front end part of the lower closing portion 41) downward. Each recess 47 is formed into a tapered shape so that a cutout width (cutout area) becomes smaller toward the rear.

Figure 8:
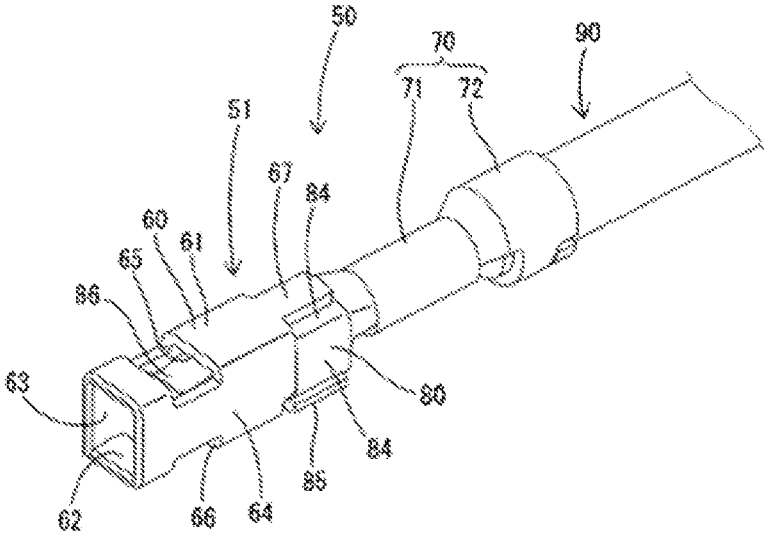
FIG. 8 is a perspective view of the terminal fitting and the part of the wire viewed obliquely from below.
Figure 9:
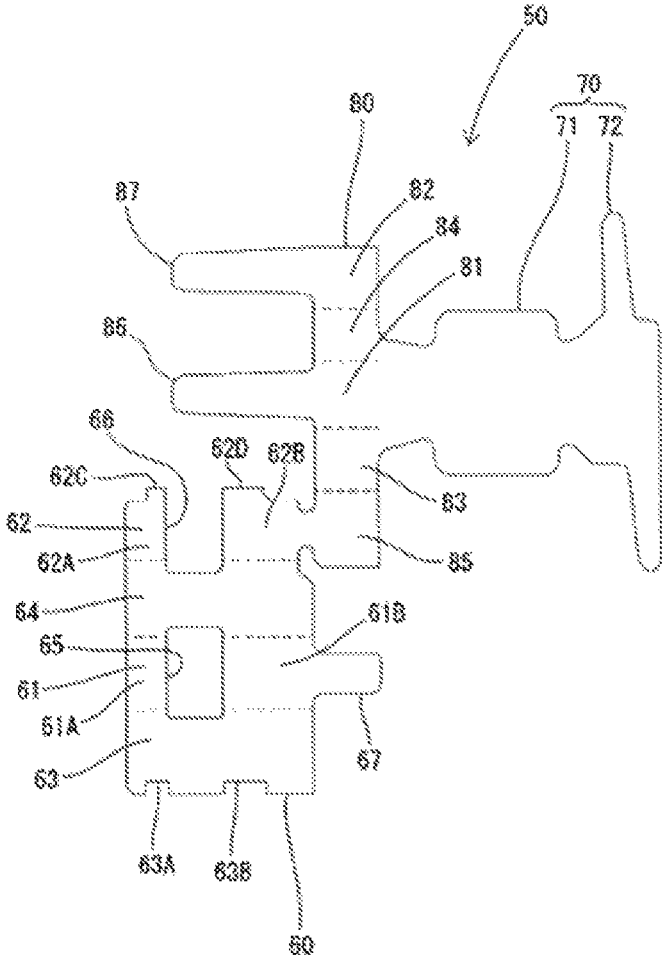
FIG. 9 is a development of the terminal fitting.
Figure 10:
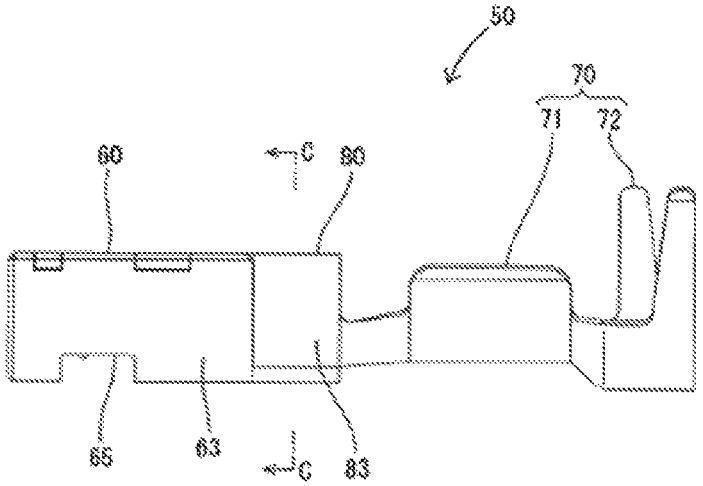
FIG. 10 is a side view of the terminal fitting.

The terminal fitting 50 is a female terminal fitting and is a single component formed by applying bending after a conductive metal plate is stamped to have a development shape shown in FIG. 9. As shown in FIGS. 7 to 12, the terminal fitting 50 is elongated in the front-rear direction, and includes a box 60, a crimping portion 70 and a coupling portion 80. The box 60 is disposed in a front part of the terminal fitting 50, is elongated in the front-rear direction and is in the form of a rectangular tube entirely accommodating two vertically symmetrical resilient contact pieces 86, 87 to be described later. The crimping portion 70 is disposed in a rear part of the terminal fitting 50 and is crimped to the outer periphery of the wire 90. The coupling portion 80 is a rectangular tube coupling a rearpart of the box 60 and a front part of the crimping portion 70. A terminal body 51 is constituted by the box 60 and the coupling portion 80. If the tab 95 of the mating terminal is inserted into the box 60 from the front (see FIG. 4), the resilient contact pieces 86, 87 contact the tab 95 of the mating terminal while resiliently sandwiching the tab 95 so that the mating terminal and the terminal body 51 are connected conductively.

Figure 7:
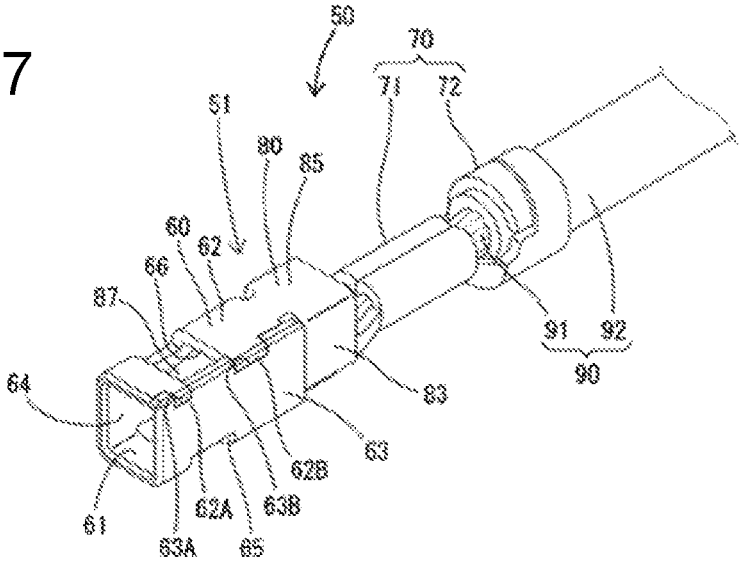
FIG. 7 is a perspective view of the terminal fitting and a part of the wire viewed obliquely from above.

As shown in FIGS. 7 to 9, the box 60 includes a box base plate 61, a box ceiling plate 62, a box right side plate 63 (box side plate as claimed), a box left side plate 64 (box side plate as claimed) and a supporting piece 67. The box base plate 61 includes a front plate 61A and a rear plate 61B spaced apart in the front-rear direction and is in the form of a long plate. The box ceiling plate 62 is arranged to substantially face the box base plate 61, includes a front plate portion 62A and a rear plate portion 62B spaced apart in the front-rear direction and is in the form of a long plate as a whole. The box right side plate 63 and the box left side plate 64 are in the form of long plates disposed substantially at a right angle to the box base plate 61 and the box ceiling plate 62. The box right side plate 63 is connected to a right part of the box base plate 61. The box left side plate 64 is connected to a left part of the box base plate 61 and a right edge part of the box ceiling plate 62. Two projections 62C, 62D project rightward on a right end part of the box ceiling plate 62. Recesses 63A, 63B are recessed down in an upper part of the box right side plate 63. The projections 62C, 62D are inserted into the recesses 63A, 63B and the box right side 63 and the box ceiling plate 62 are assembled substantially at a right angle. The box base plate 61 is disposed to cover the outer surface (lower surface in FIG. 11) of the resilient contact piece 86. The box ceiling plate 62 is disposed to cover the outer surface (upper surface in FIG. 11) of the resilient contact piece 87. The supporting piece 67 is in the form of a long plate extending rearward from a rear end part of the box base plate 61 and is disposed to overlap on the outer surface of a coupling base plate 81 to be described later. A length of the supporting piece 67 in the front-rear direction is substantially equal to a length of the coupling base plate portion 81, and overlaps on the entire outer surface of the coupling base plate 81 in the front-rear direction. The resilient contact pieces 86, 87 are respectively equivalent to examples of "first resilient contact piece" and "second resilient contact piece" of the invention.

A cutout 65 (escaping portion as claimed) is formed in an area between the front plate 61A and the rear plate 61B of the box base plate 61 and penetrates in the plate thickness direction. A front edge of the cutout 65 is formed by a rear part of the front plate 61A, and a rear edge of the cutout 65 is formed by a front part of the rear plate 61B. As shown in FIG. 4, the cutout 65 is formed substantially in the same area as a contact point T1 of the resilient contact piece 86 with the tab 95 of the mating terminal (area at and around the contact point T1) with respect to an inserting direction (front-rear direction) of the tab 95 in the box base plate 61. Specifically, the cutout 65 is formed by cutting a part of the box base plate 61 vertically overlapping a part of the resilient contact piece 86 at and around the contact point T1 with the tab 95. The resilient contact piece 86 enters the cutout 65 during deformation, thereby avoiding the interference of a front end part (extending end part) of the resilient contact piece 86 with the box 60.

A cutout 66 (escaping portion as claimed) penetrates an area between the front plate 62A and the rear plate 62B of the box ceiling plate 62 in the plate thickness direction. A front edge of the cutout 66 is formed by a rear part of the front plate 62A, and a rear edge part of the cutout portion 66 is formed by a front part of the rear plate 62B. As shown in FIG. 4, the cutout 66 is formed substantially in the same area as a contact point T1 of the resilient contact piece 87 with the tab 95 of the mating terminal (area at and around the contact point T1) with respect to the inserting direction (front-rear direction) of the tab 95 in the box ceiling plate 62. Specifically, the cutout 66 is formed by cutting a part of the box portion-side ceiling plate 62 vertically overlapping a part of the resilient contact piece 87 at and around the contact point T1 with the tab 95. The resilient contact piece 87 enters the cutout portion 66 during deformation, thereby avoiding the interference of a front part (extending part) of the resilient contact piece 87 with the box portion 60.

As shown in FIGS. 7 and 8, the crimping portion 70 is crimped and connected conductively to a tip of the wire 90. The crimping portion 70 includes a wire barrel 71 to be crimped to a core 91 at the tip of the wire 90 and an insulation barrel 72 located behind the wire barrel 71 and to be crimped to a coating 92 of the wire 90.

As shown in FIG. 12, the coupling 80 includes a coupling base plate 81, a coupling right side plate 83 (coupling side plate as claimed), a coupling left side plate 84 (coupling side plate as claimed), a coupling ceiling plate 82, a supporting wall 85, the first resilient contact piece 86 and the second resilient contact piece 87. The coupling base plate 81 is a rectangular plate. The coupling right side plate 83 and the coupling left side plate 84 are rectangular plates connected substantially at a right angle to both left and right sides of the coupling base plate 81. The coupling ceiling plate 82 is a rectangular plate extending rightward substantially at a right angle from an upper part of the coupling left side plate 84 and facing substantially parallel to the coupling base plate 81. The supporting wall 85 extends leftward substantially at a right angle from an upper part of the coupling right side plate 83 and is disposed to overlap on the outer surface of the coupling ceiling plate 82. The front edge of the supporting wall 85 is continuous and flush with the rear edge of the rear plate 62B of the box ceiling plate 62.

Figure 11:
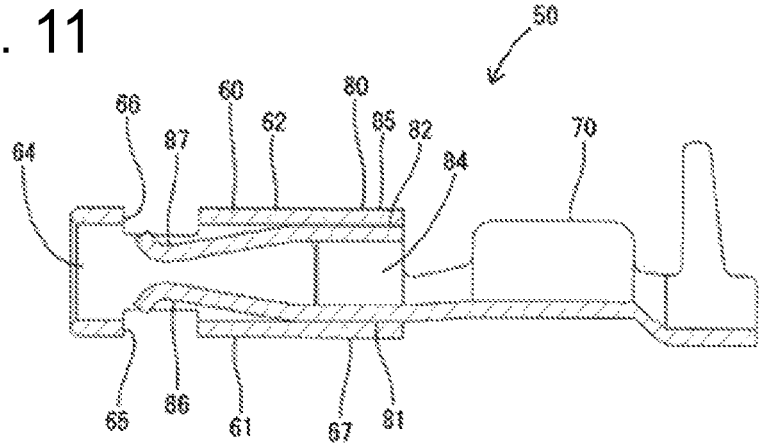
FIG. 11 is a side view in section of the terminal fitting.
Figure 12:
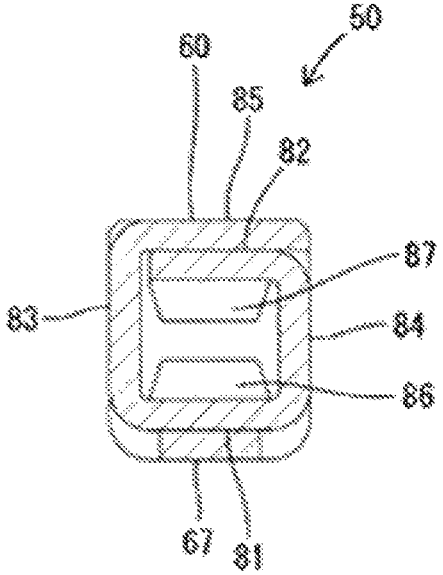
FIG. 12 is a section along C-C of FIG. 10.

As shown in FIG. 11, the first resilient contact piece 86 is a long plate connected to a front part of the coupling base plate 81 and extending forward. The first resilient contact piece 86 is cantilevered obliquely inward toward the front from the front end part of the coupling base plate 81 with a tip part thereof inclined obliquely outward, and is resiliently deformable in the vertical direction with the front end of the coupling base plate 81 (rear end part of the first resilient contact piece 86) substantially as a fulcrum. The second resilient contact piece 87 is a long plate connected to a front end part of the coupling portion-side ceiling plate portion 82 and extending forward. The second resilient contact piece 87 is cantilevered obliquely inward toward the front from the front end part of the coupling ceiling plate 82 with a tip part thereof inclined obliquely outward, and is resiliently deformable in the vertical direction with the front end part of the coupling ceiling plate 82 (rear end part of the second resilient contact piece 87) substantially as a fulcrum. The resilient contact pieces 86 and 87 extend forward from the same position in the front-rear direction (same position of the front part of the coupling portion 80 in the front-rear direction) and are vertically symmetrical.

As shown in FIG. 11, the supporting wall 85 is continuous and flush with a rear end part of the box ceiling plate 62 in the front-rear direction and is disposed to overlap on the outer surface of the coupling ceiling plate 82. As shown in FIG. 9, the entire rear end of the coupling base plate 81 and lower side areas of the rear end edges of the coupling right side plate 83 and the coupling left side plate 84 are continuous and flush with the wire barrel 71 of the crimping portion 70 in the front-rear direction.

As shown in FIG. 3, the coupling right side plate 83 and the coupling left side plate 84 are disposed respectively to be flush with and adjacent to the box right side plate 63 and the box left side plate 64 in the front-rear direction. Thus, by bending a front side of one metal plate having a developed state shown in FIG. 9 and forming the metal plate into a rectangular tube, the outer side surfaces of the terminal body 51 constituted by the box 60 and the coupling portion 80 are constituted by one plate over the entire length.

The terminal fittings 50 configured as described above are mounted into the housing 30 from above or below, as shown in FIG. 5. Three terminal fittings 50 respectively enter three terminal accommodation chambers 34 in the upper stage of the housing member 30 through the openings 35. Three terminal fittings 50 respectively enter three terminal accommodation chambers 34 in the lower stage of the housing member 30 through the openings 35. Each terminal fitting 50 entering the terminal accommodation chamber 34 in the lower stage is in a posture (state of FIG. 7) vertically inverted from the posture of the terminal fitting 50 (state of FIG. 8) entering the terminal accommodation chamber 34 in the upper stage. The restricting projection 37 is locked to a front part of the terminal fitting 50 (edge of the cutout 66) in the terminal accommodation chamber 34 in the upper stage from above. The restricting projection 37 is locked to a front part of the terminal fitting 50 (edge of the cutout 66) in the terminal accommodation chamber 34 in the lower stage from below. The withdrawal of the terminal fitting 50 in the terminal accommodation chamber 34 through the opening 35 is restricted by the restricting projection 37. The rear end parts of the coupling ceiling plate 82 and the supporting wall 85 are locked to the movement restricting portion 38 from the front. Rearward movements of the coupling ceiling plate 82 and the supporting wall 85 of the terminal fitting 50 in the terminal accommodation chamber 34 are restricted by the movement restricting portion 38.

As shown in FIGS. 3 and 4, the front member 40 is assembled from the front with the housing 30 having the terminal fittings 50 mounted therein to form the terminal unit 10. In an assembling process, the resilient locking pieces 42A, 42A of the front member 40 interfere with the locking projections 39 to be resiliently deformed leftward and rightward, and the housing 30 enters the inside of the front member 40. When the assembling is completed, the ribs 33A enter the slits 44 of the front member 40 to fill up clearances as shown in FIG. 1. The locking projections 39 of the housing 30 enter the locking holes 45 of the front member 40 and the resilient locking pieces 42A are restored resiliently. The upper closing portion 41 closes the three openings 35 on an upper surface side of the housing 30 from above, and the lower closing portion 41 closes the three openings 35 on a lower surface side of the housing 30 from below. In this way, six terminal fittings 50 are accommodated in the dielectric 20.

As shown in FIGS. 1 and 2, the insertion holes 21 are formed by the cutouts 36 of the housing 30 and the recesses 47 of the front member 40. The insertion hole 21 is tapered so that an opening area becomes smaller toward a rear side.

As shown in FIG. 4, the tab 95 of the mating terminal inserted into the insertion hole 21 is inserted into the terminal accommodation chamber 34 from the front. The first and second resilient contact pieces 86, 87 contact the tab 95 while resiliently sandwiching the tab 95, and the mating terminal and the terminal body 51 are connected conductively. According to this configuration, stresses generated in the respective resilient contact pieces 86, 87 can be reduced by distributing a reaction force applied to the resilient contact pieces from the tab 95 as compared to a conventional configuration in which one resilient contact piece is deformed resiliently to contact a tab. Moreover, since the first and second resilient contact pieces 86, 87 are accommodated in the box 60, the resilient contact pieces 86, 87 can be surrounded and protected by the box 60 and cannot be subjected to an external impact.

As shown in FIG. 4, when the resilient contact pieces 86, 87 are resiliently deformed while sandwiching the tab 95, tip parts thereof respectively enter the cutouts 65, 66. In this way, the interference of the resilient contact pieces 86, 87 with the box 60 can be avoided.

Generally, in a terminal fitting configured such that a tab of a mating terminal contacts a resilient contact piece in a box, metal parts (specifically, the tab and the resilient contact piece) are concentrated at and around a contact point of the resilient contact piece with the tab. Thus, the magnitude of an impedance differs from those in other conductive parts (parts where metal parts are not concentrated). Accordingly, in the present invention, the cutouts 65, 66 are formed substantially in the same areas (areas at and around the contact points T1) of the box 60 as the contact points T1 of the resilient contact pieces 86, 87 with the tab 95 of the mating terminal in the inserting direction of the tab 95. Thus, even if the tab 95 and the resilient contact pieces 86, 87 made of metal overlap at and around the contact points T1 of the terminal body 51 with the tab 95, it is possible to adjust the magnitude of an impedance at and around the contact points T1 for impedance matching with the other conductive parts (parts such as the terminal body portion 51).

As shown in FIG. 4, the outer surface of the coupling base plate 81 is disposed to overlap on the inner surface of the supporting piece 67, and the outer surface of the supporting piece 67 is disposed to overlap on the inner surface of the closing portion 41. Since the resilient contact piece 86 is connected to the front of the coupling base plate 81 and extends forward, the position (S1) of the front of the coupling base plate 81 serves as the position of a fulcrum of resilient deformation. If the supporting piece 67 is not provided, a clearance is formed between the coupling base plate 81 and the closing portion 41 and the position of the fulcrum of resilient deformation of the resilient contact piece 86 becomes unclear. However, no clearance is present between the coupling base plate 81 and the closing portion 41 in this configuration. Thus, the position (S1) of the front of the coupling base plate 81 serves as the position of the fulcrum, which is clear. The outer surface of the coupling ceiling plate 82 is disposed to overlap on the inner surface of the supporting wall 85, and the outer surface of the supporting wall 85 is disposed to overlap on the outer surface of the base plate 31. Since the resilient contact piece 87 is connected to the front of the coupling ceiling plate 82 and extends forward, the front (S2) of the coupling ceiling plate 82 serves as the position of a fulcrum of resilient deformation. If the supporting wall 85 is not provided, a clearance is formed between the coupling ceiling plate 82 and the closing portion 41 and the position of the fulcrum of resilient deformation of the resilient contact piece 87 becomes unclear. However, since no clearance is present between the coupling ceiling plate 82 and the closing portion 41 in this configuration, the position (S2) of the front of the coupling ceiling plate 82 serves as the position of the fulcrum, which is clear. Since the positions S1, S2 of the respective fulcrums in the resilient contact pieces 86, 87 are the same position in the front-rear direction, the resilient contact pieces 86, 87 are vertically symmetrical and resiliently deformed to sandwich the tab 95 having entered the box 60.

The terminal fitting 50 of this embodiment includes the box 60 in the form of a rectangular tube and the first and second resilient contact pieces 86, 87 capable of contacting the tab 95 of the mating terminal inserted into the box 60 while resiliently sandwiching the tab 95. Since the first and second resilient contact pieces 86, 87 are configured to contact the tab 95 of the mating terminal while resiliently sandwiching the tab 95 as just described, the amount of deflection of one resilient contact piece can be reduced and a stress generated in each resilient contact piece 86, 87 can be reduced as compared to a configuration in which one resilient contact piece is resiliently deformed to contact the tab 95.

Walls (box base plate 61 and box ceiling plate 62) constituting the box 60 are cut substantially in the same areas as the contact points T1, T1 of the resilient contact pieces 86, 87 with the tab 95 with respect to the inserting direction of the tab 95, thereby forming the cutouts 65, 66. According to this configuration, by cutting the walls constituting the box 60 substantially in the same areas as the contact points T1, T1 of the resilient contact pieces 86, 87 with the tab 95 with respect to the inserting direction of the tab 95 to form the cutouts 65, 66, an impedance near the contact points T1, T1 of the resilient contact pieces 86, 87 in the terminal fitting 50 can be adjusted. By changing the impedance near the contact points T1, T1 of the resilient contact pieces, this impedance can be matched with impedances in parts of the terminal fitting 50 different from the areas near the contact points T1, T1.

The box 60 is formed with the cutouts 65, 66 capable of avoiding interference with the front end parts (extending end parts) of the resilient contact pieces 86, 87. According to this configuration, the resilient contact pieces 86, 87 enter the cutouts 65, 66 to avoid interference with the box 60 when being resiliently deformed to sandwich the tab 95. In this way, improper deformation of the resilient contact pieces can be prevented.

The terminal fitting 50 includes the crimping portion 70 to be crimped to the outer periphery of the core 91 of the wire 90, and the coupling portion 80 formed into a rectangular tube by bending the metal plate and coupling the rear end of the box 60 and the front end part of the crimping portion 70. The box 60 includes the box base plate 61 disposed to cover the outer surface of the resilient contact piece 86, the box ceiling plate 62 disposed to cover the outer surface of the resilient contact piece 87, and the box right side plate 63 and the box left side plate 64 disposed substantially at a right angle to the box base plate 61 and the box ceiling plate 62. The coupling 80 includes the coupling base plate 81 connected to the rear end of the resilient contact piece 86, the coupling right side plate 83 and the coupling left side plate 84 respectively connected substantially at a right angle to the left and right parts of the coupling base plate 81, and the coupling ceiling plate 82 extending substantially at a right angle from the coupling left side plate 84, facing substantially parallel to the coupling base plate 81 and connected to the rear of the resilient contact piece 87. The rear ends of the box right side plate 63 and the box left side plate 64 and the front ends of the coupling right side plate 83 and the coupling left side plate 84 are disposed respectively to be flush with and adjacent to each other. According to this configuration, the rear ends of the box right side plate 63 and the box left side plate 64 and the front end parts of the coupling right side plate 83 and the coupling left side plate 84 are disposed respectively to be flush with and adjacent to each other. Thus, a lateral width of the box 60 can be made smaller in accordance with a lateral width of the coupling 80 and the terminal fitting 50 can be reduced in size while a part constituted by the box 60 and the coupling portion 80 is formed by bending one metal plate.

The resilient contact piece 86 is resiliently deformable with the front end of the coupling base plate 81 substantially as a fulcrum. The resilient contact piece 87 is resiliently deformable with the front part of the coupling ceiling plate 82 substantially as a fulcrum. The coupling portion 80 includes the supporting wall 85 extending from the edge of the coupling right side plate 83 and disposed to overlap on the outer surface of the coupling ceiling plate 82. The box 60 includes the supporting piece 67 extending from the edge of the box base plate 61 and disposed to overlap on the outer surface of the coupling base plate 81. According to this configuration, since the supporting wall 85 extending from the edge of the coupling right side plate 83 is disposed to overlap on the outer surface of the coupling ceiling plate 82, the position of the fulcrum of resilient deformation of the resilient contact piece 87 connected to the coupling ceiling plate portion 82 can be set clearly as the position (S2) of the front end part of the coupling ceiling plate 82. Since the supporting piece 67 extending rearward from the rear part of the box base plate 61 is disposed to overlap on the outer surface of the coupling base plate 81, the position of the fulcrum of resilient deformation of the resilient contact piece 86 connected to the coupling base plate 81 can be set clearly as the position (S1) of the front end part of the coupling base plate 81.

Other Embodiments

The invention is not limited to the above described and illustrated embodiment. For example, the following embodiments also are included in the scope of the invention.

In the above embodiment, less than or more than three terminal accommodation chambers 34 in the upper stage and less than or more than three terminal accommodation chambers 34 in the lower stage may be provided in the housing member 30.

Although the cutouts 65, 66 respectively penetrate through the box base plate 61 and the box ceiling plate 62 in the plate thickness direction in the above embodiment, the cutouts 65, 66 may be recesses not penetrating in the plate thickness direction.

Although the length of the supporting piece 67 in the front-rear direction is substantially equal to the length of the coupling base plate 81 in the above embodiment, the length of the supporting piece 67 may be different from that of the coupling base plate 81 if the position of the fulcrum of the resilient contact piece 86 is located at the position of the front part of the coupling base plate 81 (rear end part of the resilient contact piece 86).

LIST OF REFERENCE SIGNS

50 . . . terminal fitting
60 . . . box
61 . . . box base plate
62 . . . box ceiling plate
63 . . . box right side plate
64 . . . box left side plate
65, 66 . . . cutout (escaping portion)
67 . . . supporting piece
70 . . . crimping portion
80 . . . coupling portion
81 . . . coupling base plate
82 . . . coupling ceiling plate
83 . . . coupling right side plate
84 . . . coupling left side plate
85 . . . supporting wall
86, 87 . . . resilient contact piece
90 . . . wire
91 . . . core
95 . . . tab
S1, S2 . . . fulcrum position
T1 . . . contact point

The invention claimed is:

1. A terminal fitting, comprising:

a box in the form of a rectangular tube;

first and second resilient contact pieces accommodated in the box, the resilient contact pieces being capable of contacting a tab of a mating terminal inserted into the box while resiliently sandwiching the tab;

a crimping portion to be crimped to an outer periphery of a core of a wire; and a coupling portion formed into a rectangular tube by bending a metal plate, the coupling portion coupling a rear end part of the box and a front end part of the crimping portion, wherein:

the box includes:

a box base plate disposed to cover an outer surface of the first resilient contact piece;

a box ceiling plate disposed to cover an outer surface of the second resilient contact piece; and left and right box side plates disposed substantially at a right angle to the box base plate and the box ceiling plate, the coupling portion includes:

a coupling base plate connected to a rear end of the first resilient contact piece;

left and right coupling side plates connected substantially at a right angle to both left and right edge parts of the coupling base plate; and a coupling ceiling plate extending substantially at a right angle from one of the coupling side plates, facing substantially parallel to the coupling base plate and connected to a rear end part of the second resilient contact piece, rear end parts of the left and right box side plates and front end parts of the left and right coupling side plates are flush with and adjacent to each other, and a wall constituting the box is cut substantially in the same area as contact points of the resilient contact pieces with the tab with respect to an inserting direction of the tab, thereby forming a cutout for impedance matching.

2. The terminal fitting of claim 1, wherein the cutout for impedance matching is disposed in the box for accommodating resilient deformation of the resilient contact pieces.

3. The terminal fitting of claim 2, wherein:

the first resilient contact piece is resiliently deformable with a front end of the coupling base plate substantially as a fulcrum, the second resilient contact piece is resiliently deformable with a front end of the coupling ceiling plate substantially as a fulcrum, the coupling portion includes a supporting wall extending from an edge of the other coupling side plate and disposed to overlap on an outer surface of the coupling ceiling plate, and the box includes a supporting piece extending rearward from a rear end part of the box base plate and disposed to overlap on an outer surface of the coupling base plate.

4. A terminal fitting, comprising:

a box in the form of a rectangular tube;

first and second resilient contact pieces accommodated in the box, the resilient contact pieces being capable of contacting a tab of a mating terminal inserted into the box while resiliently sandwiching the tab;

a crimping portion to be crimped to an outer periphery of a core of a wire; and a coupling portion formed into a rectangular tube by bending a metal plate, the coupling portion coupling a rear end part of the box and a front end part of the crimping portion, wherein:

the box includes:

a box base plate disposed to cover an outer surface of the first resilient contact piece;

a box ceiling plate disposed to cover an outer surface of the second resilient contact piece; and left and right box side plates disposed substantially at a right angle to the box base plate and the box ceiling plate, the coupling portion includes:

a coupling base plate connected to a rear end of the first resilient contact piece;

left and right coupling side plates connected substantially at a right angle to both left and right sides of the coupling base plate; and a coupling ceiling plate portion extending substantially at a right angle from one of the coupling side plates, facing substantially parallel to the coupling base plate and connected to a rear end part of the second resilient contact piece, rear end parts of the left and right box side plates and front end parts of the left and right coupling side plates are flush with and adjacent to each other.

5. The terminal fitting of claim 4, wherein:

the first resilient contact piece is resiliently deformable with a front end of the coupling base plate substantially as a fulcrum, the second resilient contact piece is resiliently deformable with a front end of the coupling ceiling plate substantially as a fulcrum, the coupling portion includes a supporting wall extending from an edge of the other coupling side plate and disposed to overlap on an outer surface of the coupling ceiling plate, and the box includes a supporting piece extending rearward from a rear end part of the box base plate and disposed to overlap on an outer surface of the coupling base plate.

6. The terminal fitting of claim 4, wherein the left and right box side plates are formed formed respectively with cutouts disposed and configured to accommodate resilient deformation of the resilient contact pieces.

* * * * *